US010612737B2

(12) United States Patent
Chami et al.

(10) Patent No.: US 10,612,737 B2
(45) Date of Patent: Apr. 7, 2020

(54) MODULAR SOLID STATE HIGH BAY LIGHTING FIXTURE WITH HINGED ACCESS PANEL

(71) Applicant: MAXLITE, INC., West Caldwell, NJ (US)

(72) Inventors: Aymen Chami, Hackettstown, NJ (US); Eric Clohosey, East Rutherford, NJ (US)

(73) Assignee: MAXLITE, INC., West Caldwell, NJ (US)

( * ) Notice: Subject to any disclaimer, the term of this patent is extended or adjusted under 35 U.S.C. 154(b) by 0 days.

(21) Appl. No.: 16/031,574

(22) Filed: Jul. 10, 2018

(65) Prior Publication Data

US 2020/0018453 A1 Jan. 16, 2020

(51) Int. Cl.

| | |
|---|---|
| ***F21V 11/00*** | (2015.01) |
| ***F21S 8/04*** | (2006.01) |
| ***F21S 8/06*** | (2006.01) |
| ***F21V 17/10*** | (2006.01) |
| ***F21V 7/00*** | (2006.01) |
| ***F21V 23/00*** | (2015.01) |
| *F21Y 115/15* | (2016.01) |
| *F21Y 103/10* | (2016.01) |

(52) U.S. Cl.

CPC ..... *F21S 8/046* (2013.01); *F21S 8/061* (2013.01); *F21V 7/005* (2013.01); *F21V 17/107* (2013.01); *F21V 23/009* (2013.01); *F21Y 2103/10* (2016.08); *F21Y 2115/15* (2016.08)

(58) Field of Classification Search

CPC .. F21S 2/005; F21S 8/043; F21S 8/046; F21S 8/061

See application file for complete search history.

(56) References Cited

U.S. PATENT DOCUMENTS

| | | | | |
|---|---|---|---|---|
| 3,211,905 | A * | 10/1965 | Picha | F21S 2/005 362/222 |
| 8,573,799 | B2 * | 11/2013 | Lee | F21S 2/005 362/217.12 |
| 2003/0021104 | A1 * | 1/2003 | Tsao | F21S 8/024 362/95 |
| 2018/0142850 | A1 | 5/2018 | Chami et al. | |

* cited by examiner

*Primary Examiner* — Matthew J. Peerce
(74) *Attorney, Agent, or Firm* — Budzyn IP Law, LLC

(57) ABSTRACT

A modular solid state high bay lighting fixture is provided herein which includes at least two lighting modules, each including a body configured to define an open channel along one face thereof with a lens or diffuser at least partly overlying each of the open channels. Bottom and upper plates extend between the lighting modules with the upper plate being spaced from, and at least partially overlying, the bottom plate so that a chamber is formed therebetween. The bottom plate is movable relative to the bodies of the lighting module from a first state, where the bottom plate is edge supported, to a second state, where one edge is clear of the bodies allowing the bottom plate to rotate.

7 Claims, 28 Drawing Sheets

MODULAR SOLID STATE HIGH BAY LIGHTING FIXTURE WITH HINGED ACCESS PANEL

BACKGROUND OF THE INVENTION

High bay lighting fixtures are known in the prior art. In general, high bay lighting fixtures are used in high clearance areas, such as warehouses, manufacturing facilities, garages, etc., to provide well distributed and uniform light. Typically, high bay lighting fixtures utilize fluorescent or HID (high intensity discharge) lighting.

U.S. Published Patent Appl. No. 2018/0142850, to the assignee herein, discloses a modular solid state lighting fixture. This lighting fixture includes a bottom plate which may be edge mounted and, optionally, hingedly connected.

SUMMARY OF THE INVENTION

A modular solid state high bay lighting fixture is provided herein which includes at least two lighting modules, each including a body configured to define an open channel along one face thereof. A plurality of solid state light generating elements are located in the open channels of the bodies, with a lens or diffuser at least partly overlying each of the open channels. Bottom and upper plates extend between the lighting modules with the upper plate being spaced from, and at least partially overlying, the bottom plate so that a chamber is formed therebetween. The bottom plate is movable relative to the bodies of the lighting module from a first state, where the bottom plate is edge supported, to a second state, where one edge is clear of the bodies allowing the bottom plate to rotate. A pair of endcaps are provided on opposite ends of the lighting modules. Advantageously, the subject invention allows for a solid state lighting fixture to be prepared in modular form which allows for both width and length adjustment.

These and other features of the subject invention will be better understood through a study of the following detailed description and accompanying drawings.

DETAILED DESCRIPTION OF THE INVENTION

Figure 1:
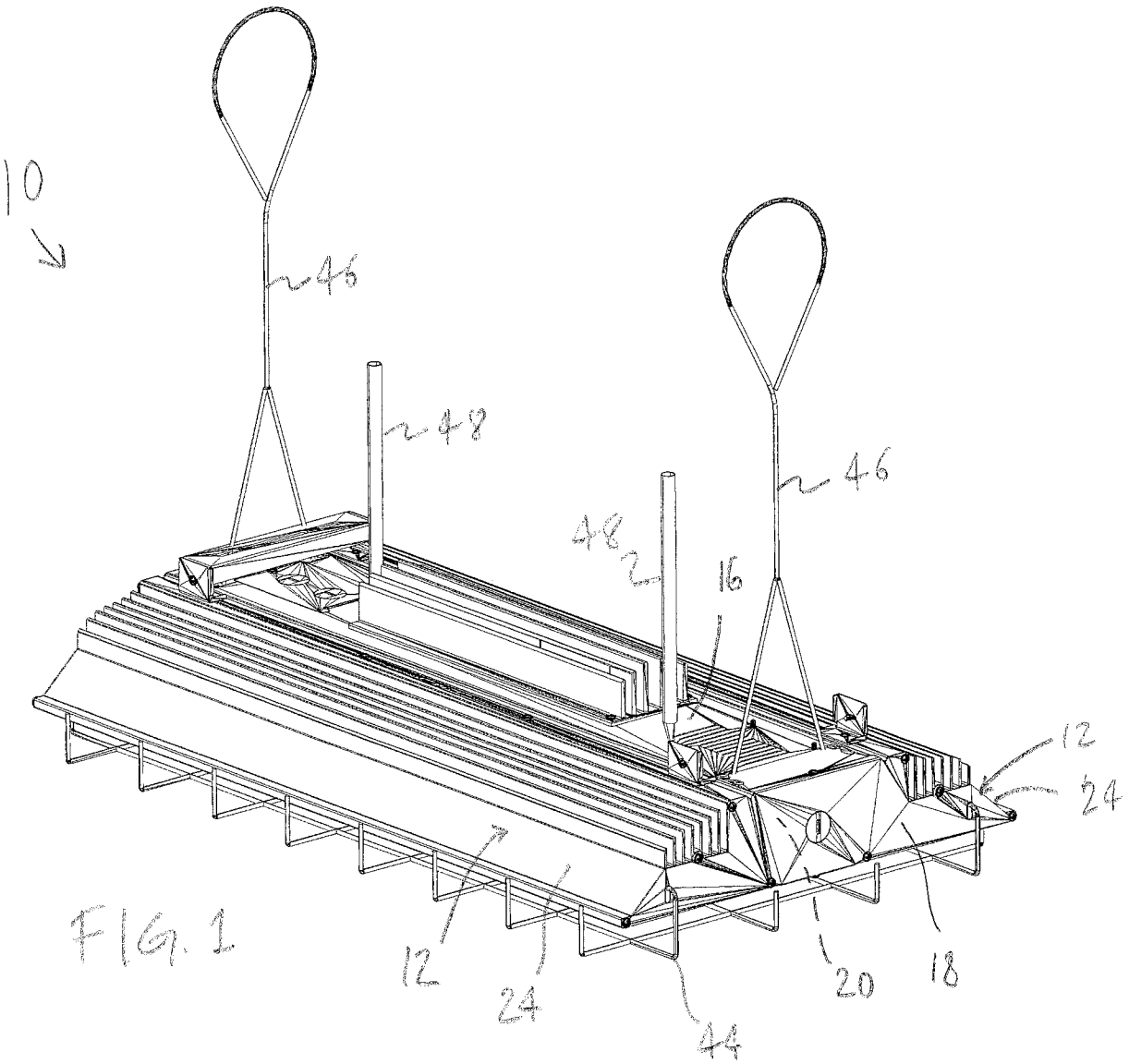
FIGS. 1 and 2 are perspective views of a lighting fixture formed in accordance with the subject invention.
Figure 2:
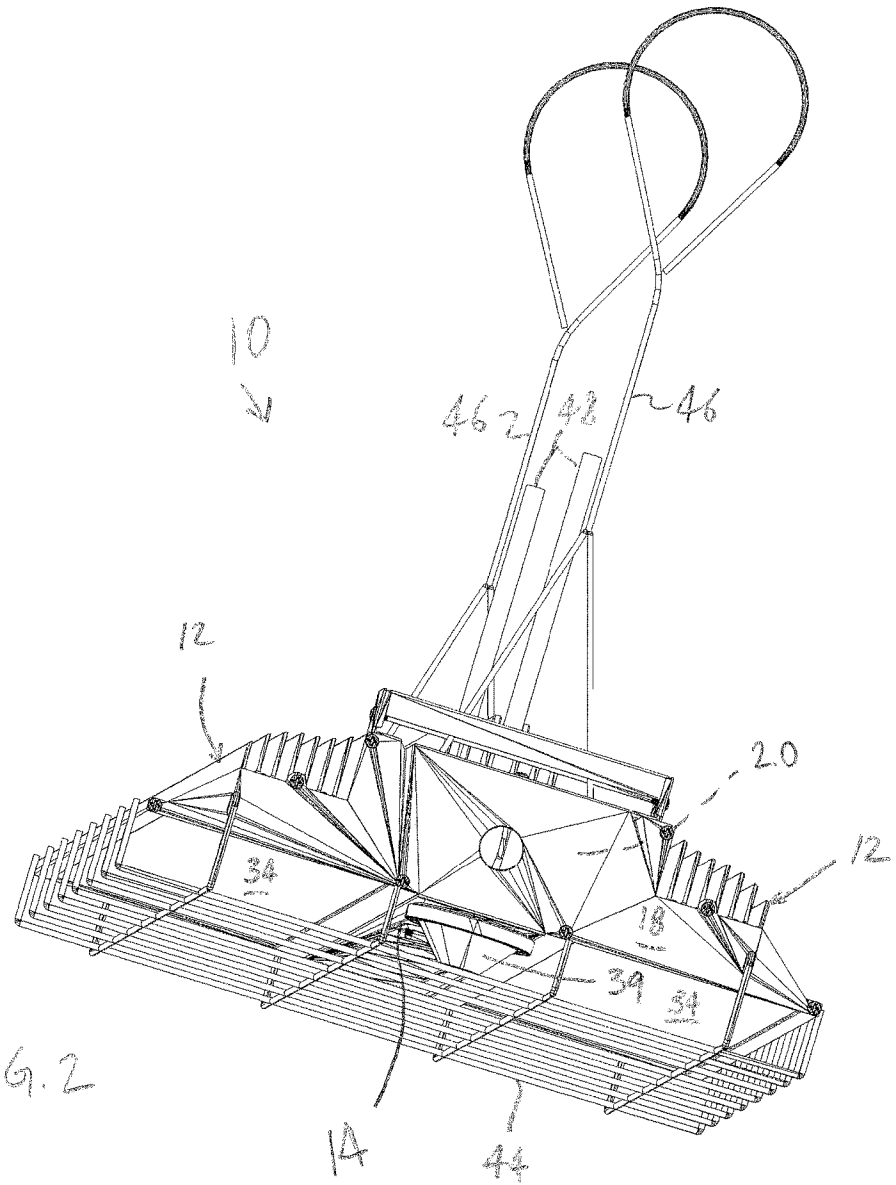

With reference to FIGS. 1-2, a solid state high bay lighting fixture 10 is shown useable in various applications, including high-mounting applications. The lighting fixture 10 may be cable mounted, pendant mounted or surface mounted.

The lighting fixture 10 generally includes at least two lighting modules 12, at least one bottom plate 14, at least one upper plate 16, and at least two endcaps 18. The lighting fixture 10 is formed from these components as a wholly-contained lighting fixture, including at least one chamber 20 for receiving a driver 22 and other electrical components as needed.

Figure 3:
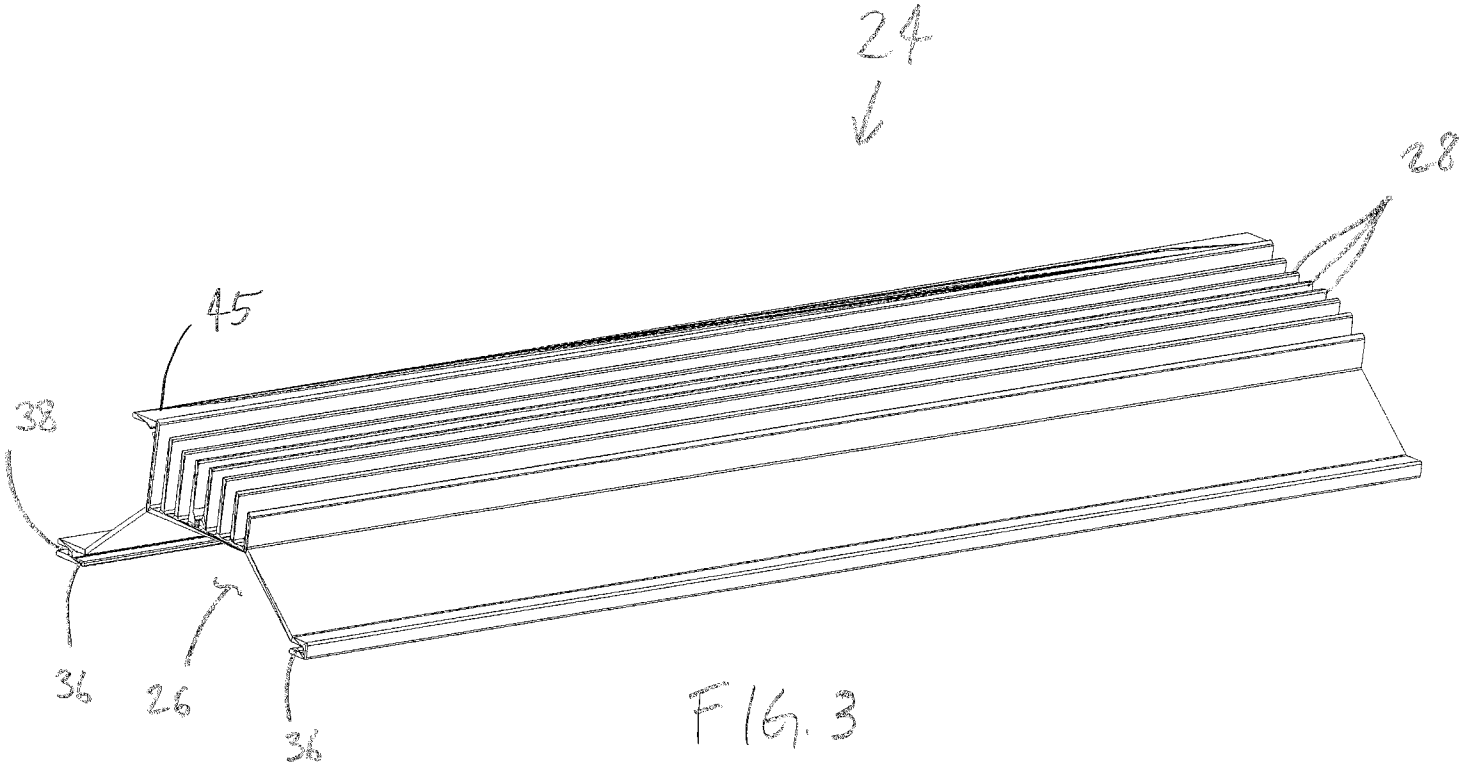
FIGS. 3-5 show a body in accordance with the subject invention.
Figure 4:
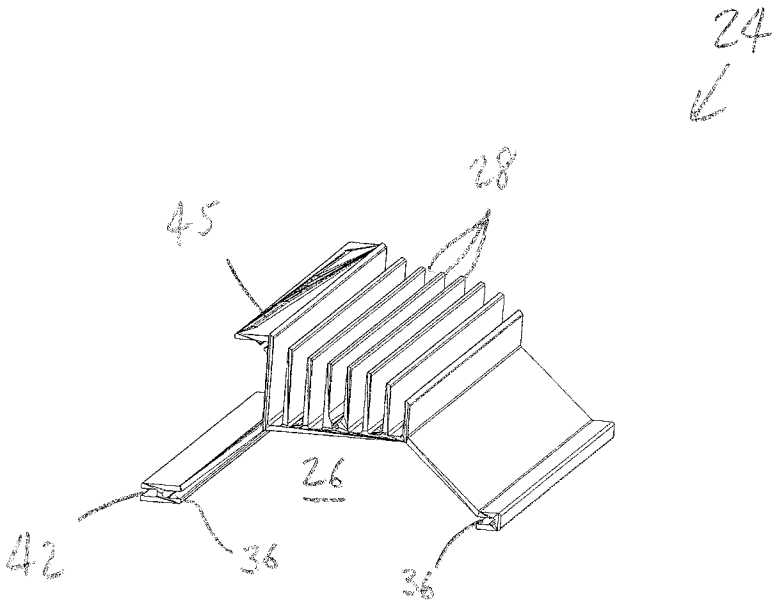
Figure 5:
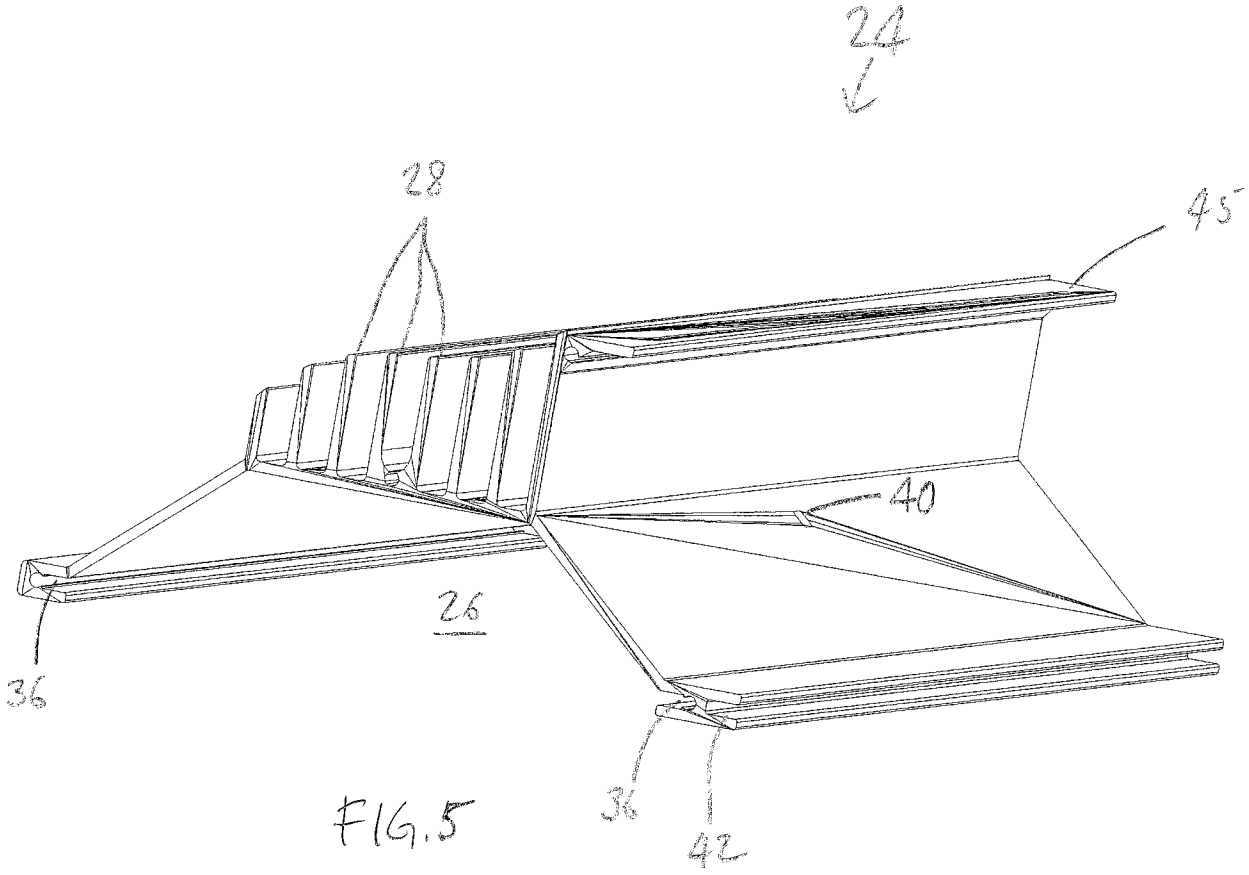
Figure 6:
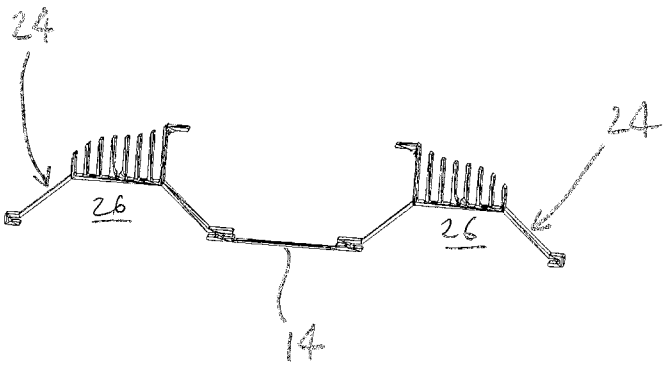
FIGS. 6-7 show a bottom plate extending between two bodies in accordance with the subject invention.

The lighting modules 12 each include a body 24 (FIGS. 3-5) configured to define an open channel 26 along one face thereof. The body 24 is preferably formed of a material having good heat conductivity properties, such as metal (e.g., aluminum). The body 24 may be formed with a generally constant cross-section, thus allowing for formation by extrusion. The body 24 may include a plurality of protruding fins 28. The fins 28 allow for improved heat dissipation. The fins 28 may be formed on the body 24 opposite the open channel 26. The body 24 may have the same cross-section for each of the lighting modules 12, but oriented differently relative to the lighting fixture 10, e.g., to present the fins 28 in symmetrical fashion as shown in the Figures.

Figure 11:
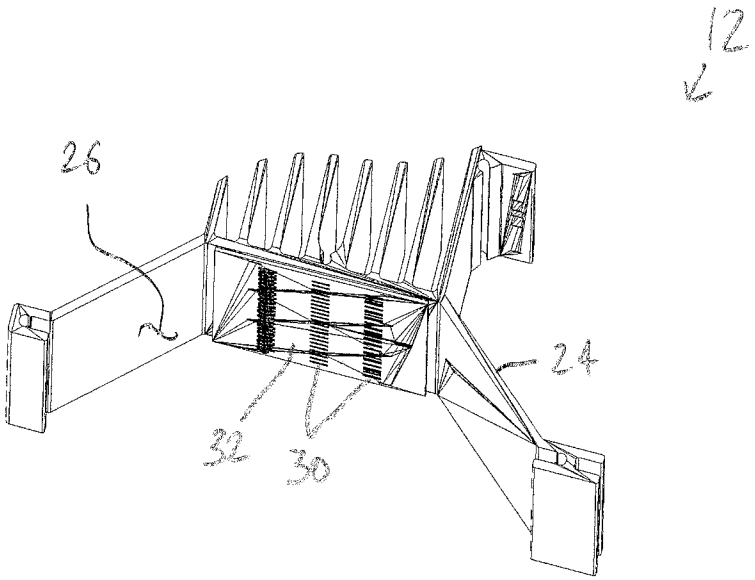
FIGS. 11-13 show solid state lighting elements mounted to a body in accordance with the subject invention.
Figure 12:
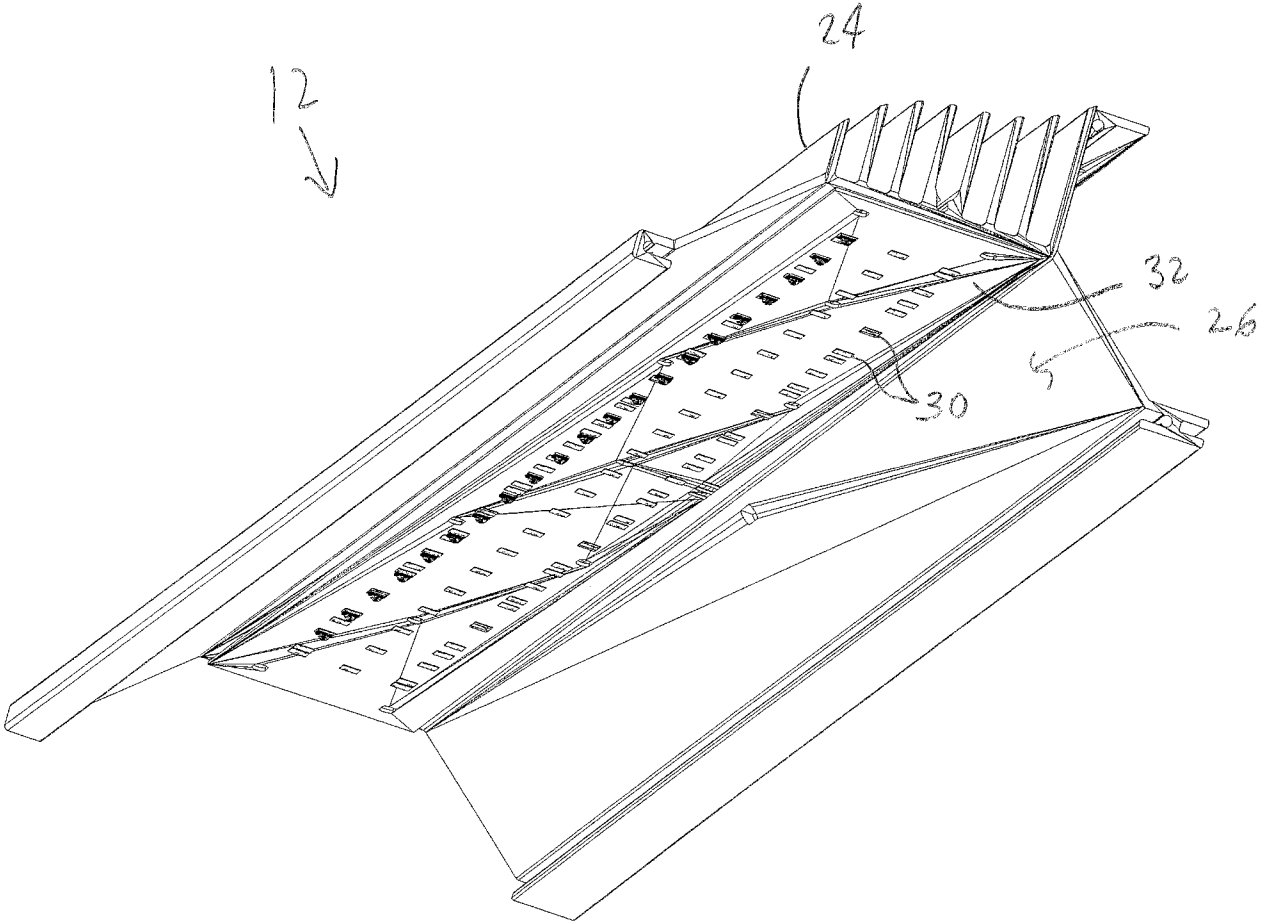
Figure 13:
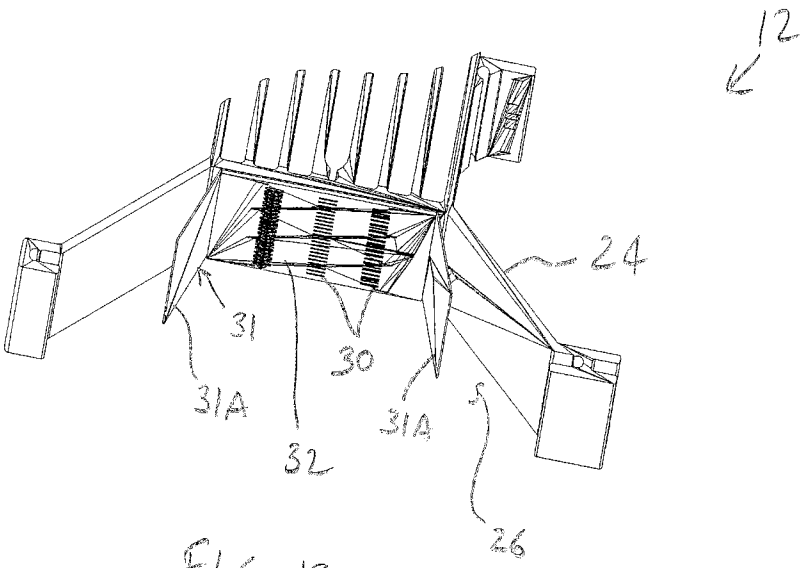

As shown in FIGS. 11-13, a plurality of solid state lighting elements 30 is disposed within each of the open channels 26. The solid state lighting elements 30 may be provided mounted directly to the body 24 and/or may be provided as an integrated circuit with a board 32 (such as a PCB (printed circuit board)). The solid state lighting elements 30 may be mounted and electrically coupled in any known manner. The board 32 in turn may be mounted to the body 24. The solid state lighting elements 30 may be of any form, including, but not limited to, LED (light emitting diode), OLED (organic light emitting diode) and/or PLED (polymeric light emitting diode) form. Optionally, a reflector 31 may be provided within one or more of the open channels 26 having one or more panels 31A configured to reflect, and, thus, direct, light emitted from the solid state lighting elements 30. The reflector(s) 31 may be located at least partially between the solid state lighting elements 30 or the board 32, and the body 24.

Figure 8:
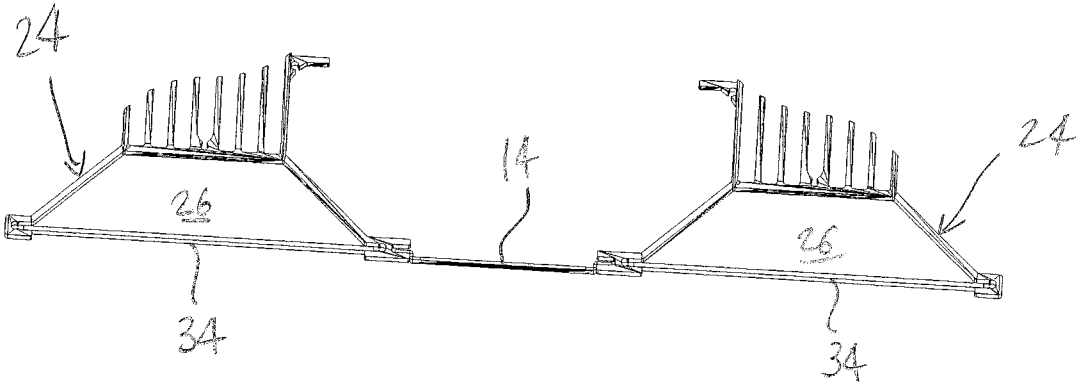
FIGS. 8-9 show the assembly of FIGS. 6-7 with a lens or diffuser mounted to each body.
Figure 9:
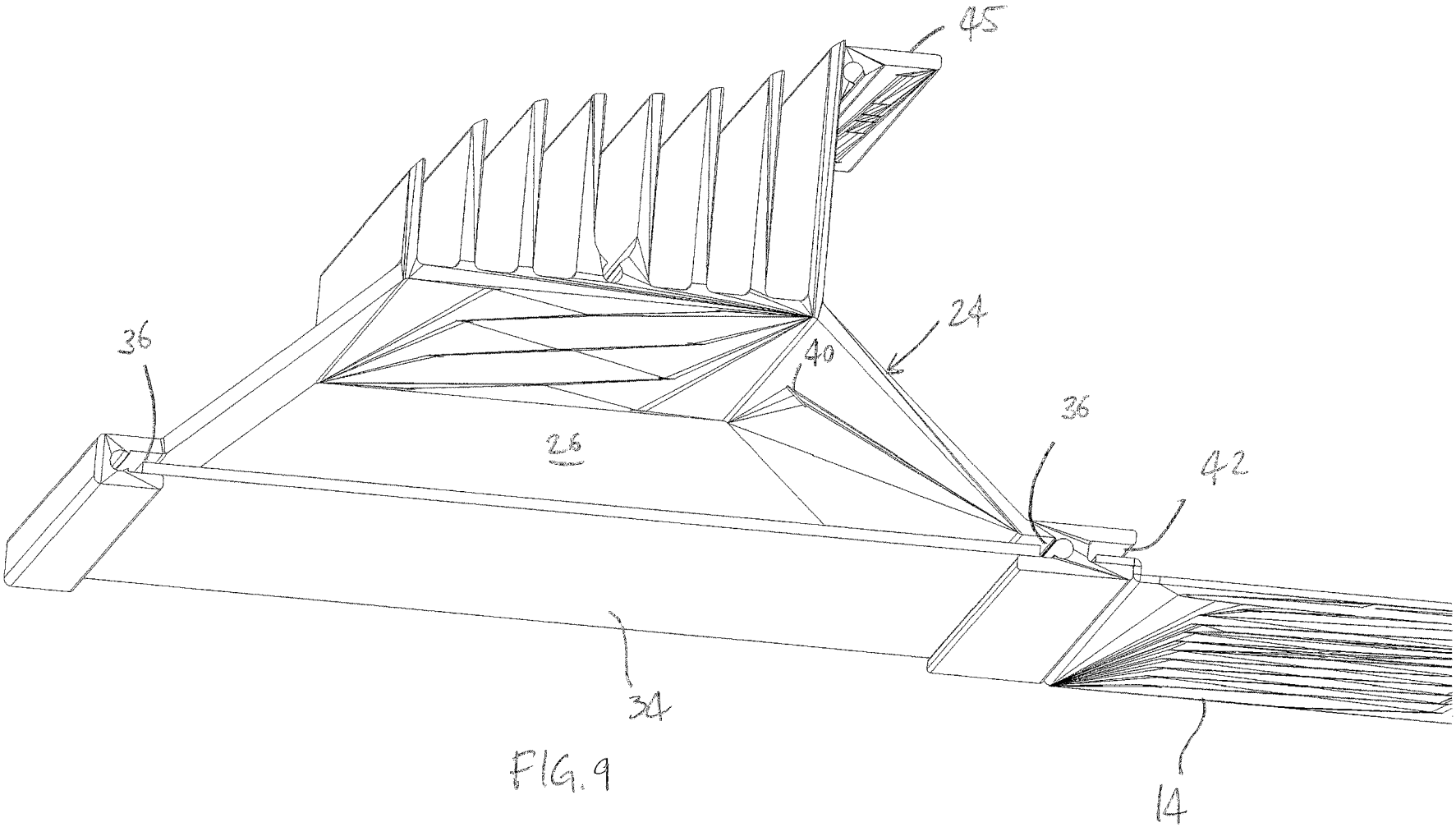
Figure 10:
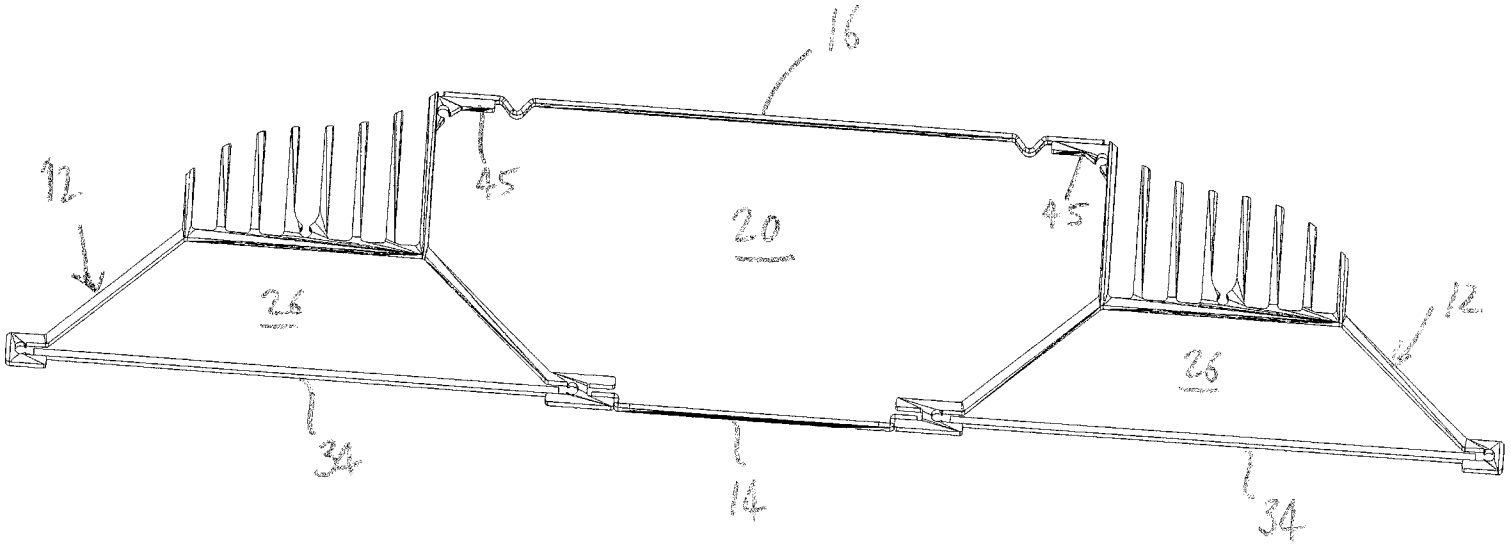
FIG. 10 shows the assembly of FIGS. 8-9 with an upper plate extending between the bodies.

As shown in FIGS. 8-10, a lens or diffuser 34 is provided for each of the lighting modules 12 formed to at least partly overlie the open channel 26 so that generated light passes therethrough. The lens or diffuser 34 may be formed with various levels of opacity so as to allow for different levels of light to pass through. The lens or diffuser 34 may be also configured to allow for spread-out or focused light distribution, as is known in the art.

Preferably, the lens or diffuser 34 overlies the entirety of the open channel 26. The body 24 may be provided with mounting channels 36 extending along edges of the open channel 26. The lens or diffuser 34 may be mounted to the body 24 with insertion into the mounting channels 36. This arrangement provides for edge mounting of the lens or diffuser 34.

The bottom plate 14 is provided to extend between, and be in contiguous contact with, a pair of the lighting modules 12. Preferably, the bottom plate 14 is positioned to be generally coplanar with at least one of the lens or diffuser 34 of an adjacent of the lighting modules 12. More preferably, the bottom plate 14 is positioned to be generally coplanar with the lens or diffuser 34 of both of the adjacent lighting modules 12. In this manner, the lighting fixture 10 is provided with a generally flat bottom appearance.

As shown in FIG. 10, the upper plate 16 is provided to extend between, and be in contiguous contact with, a pair of the lighting modules 12, with the upper plate 16 being spaced from the bottom plate 14. The upper plate 16 at least partially overlies the bottom plate 14 so as to bound opposite sides of the chamber 20.

Figure 14:
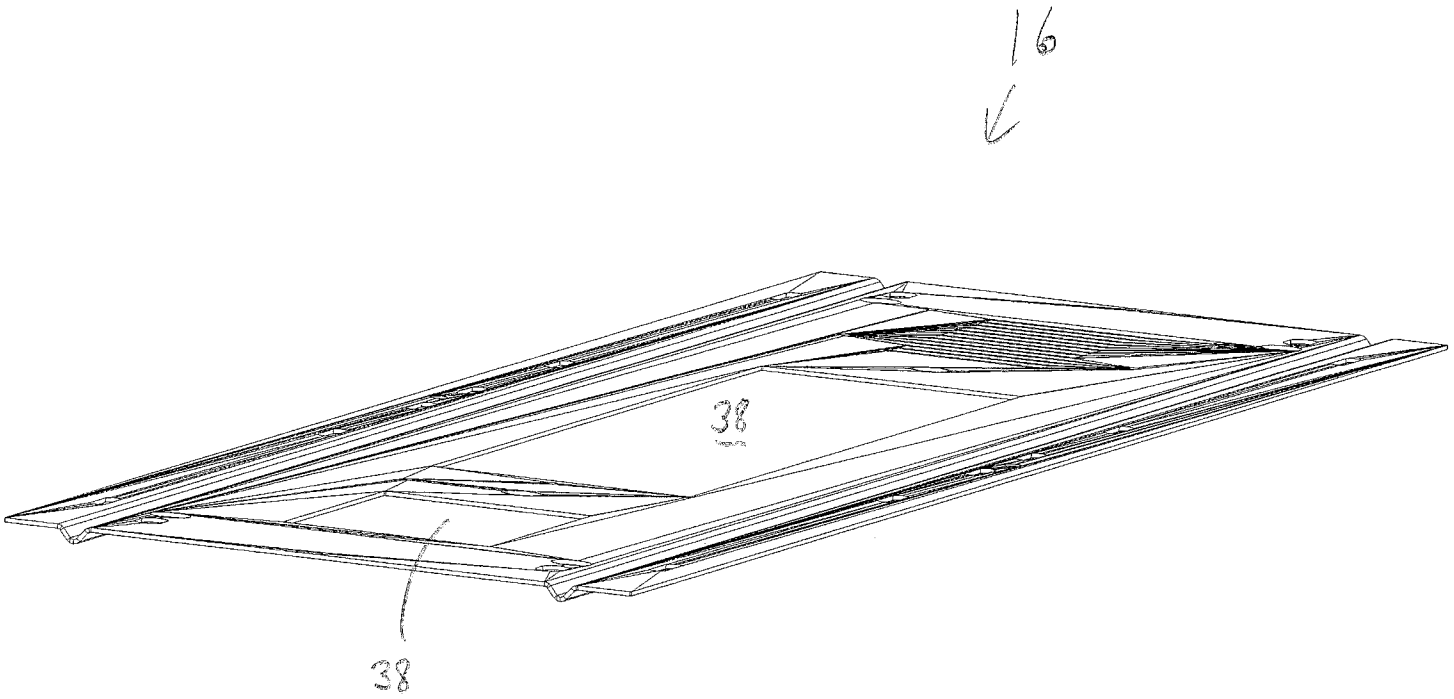
FIGS. 14-15 show an upper plate in accordance with the subject invention.
Figure 16:
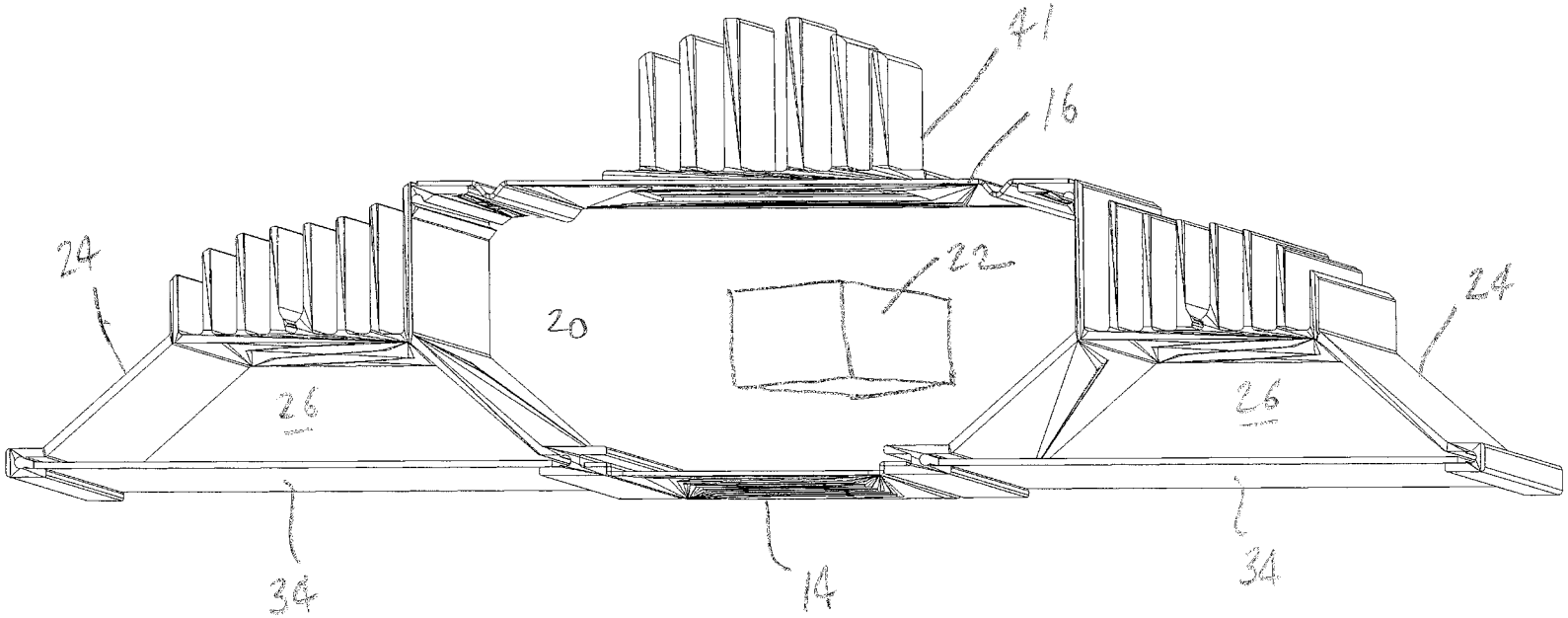
FIG. 16 show an assembly in accordance with the subject invention.
Figure 17:
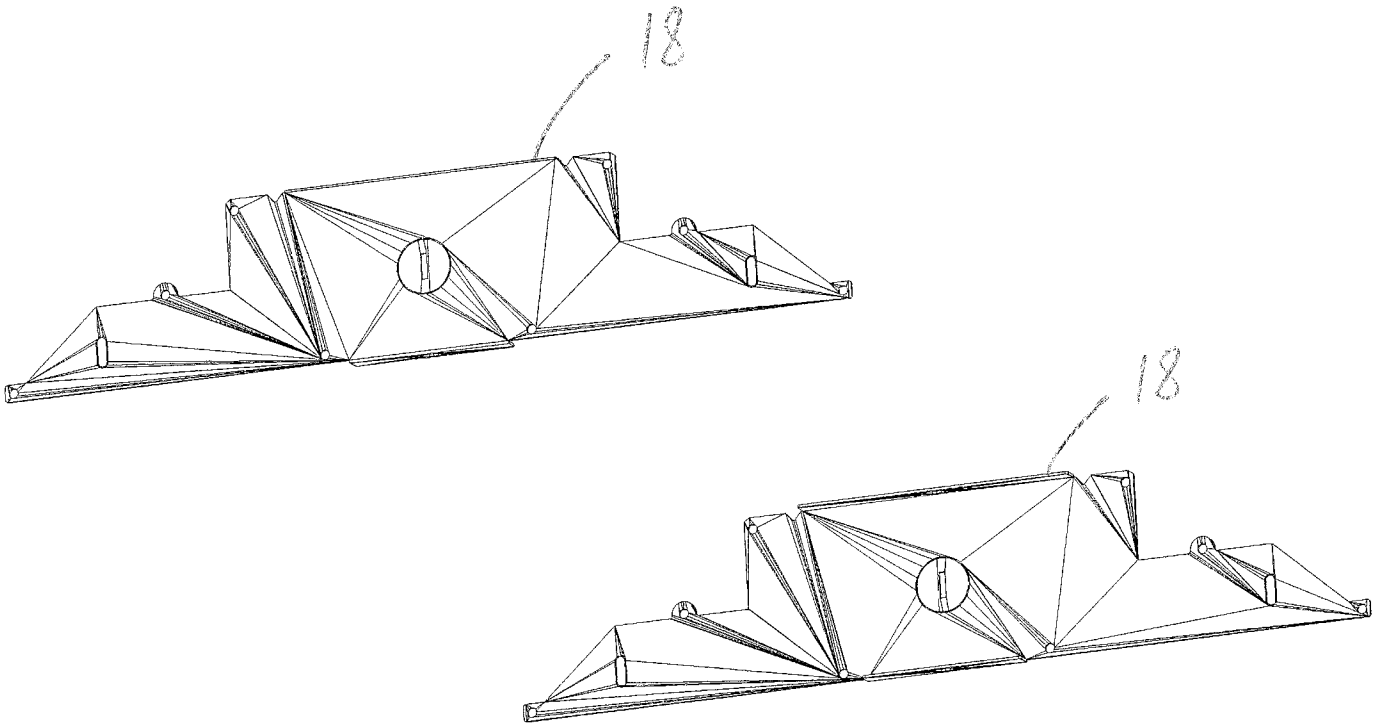
FIG. 17 shows a pair of endcaps in accordance with the subject invention.

Electronic components, including electrical power components, such as the driver 22 configured to convert alternating current into direct current, may be accommodated within the chamber 20 (FIG. 16). One or more openings 38 (FIG. 14) may be provided in the upper plate 16 to provide access to the chamber 20, to allow for passage of electrical wiring (e.g., to provide electrical power), to allow for venting, and/or to accommodate control elements. One or more sensors 39 (FIG. 2) may be provided external to the chamber 20, such as mounted to the bottom plate 14, to detect daylight or motion with the sensors 39 being electrically coupled through the bottom plate 14. One or more access holes 40 (FIG. 5) may be provided in the bodies 24 to allow for electrically coupling of the solid state lighting elements 30 with the driver 22 and any other electrical components in the chamber 20 as needed. Power is provided to the lighting fixture 10 in any known manner, including with standard alternating current, with wiring being provided to convey such electrical power into the chamber 20. Reference herein to "lens" or "diffuser" alone is understood to cover both.

Figure 15:
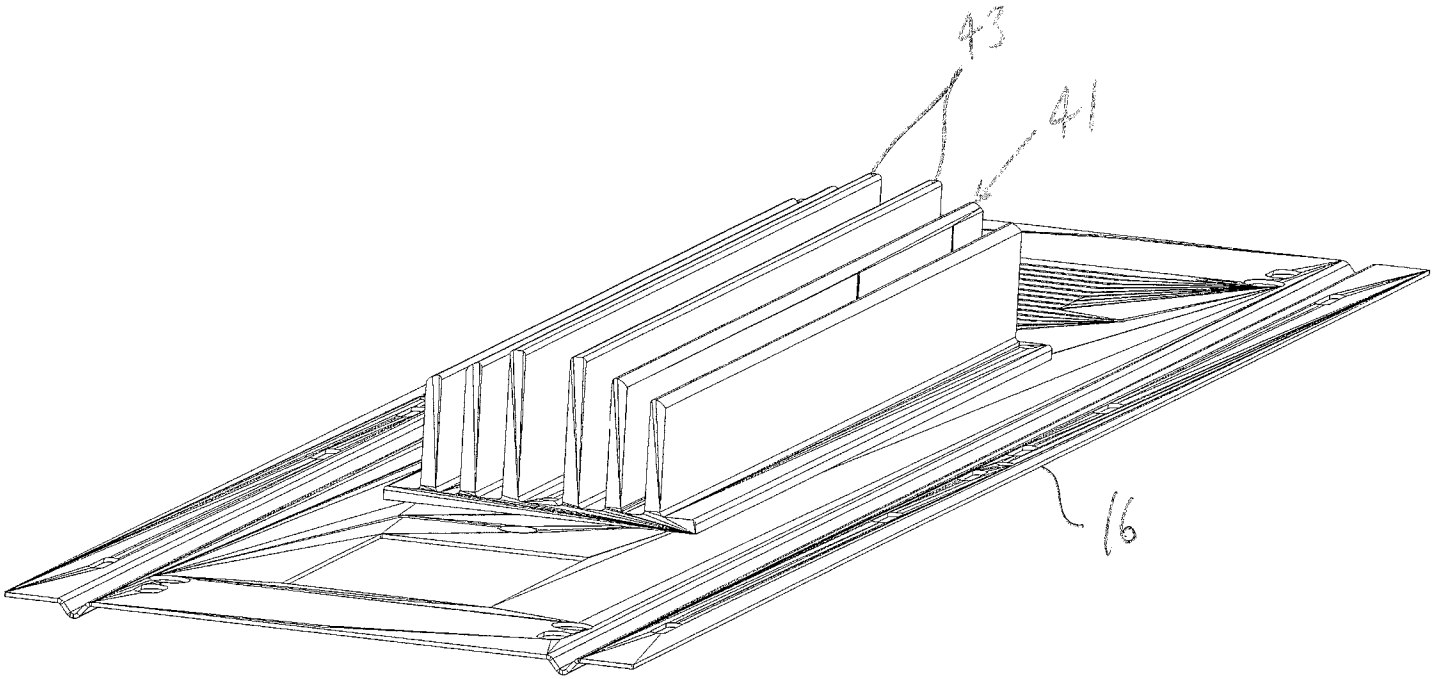

One or more heatsinks 41 (FIGS. 15-16) may be mounted to the upper plate 16, e.g., through one or more of the openings 38, to dissipate heat generated within the chamber 20. The heatsink(s) 41 may be provided with fins 43 or other protruding structures which enhance the dissipation of heat. Preferably, the heatsink(s) 41 are preferably formed of a material having good heat conductivity properties, such as metal (e.g., aluminum).

Figure 7:
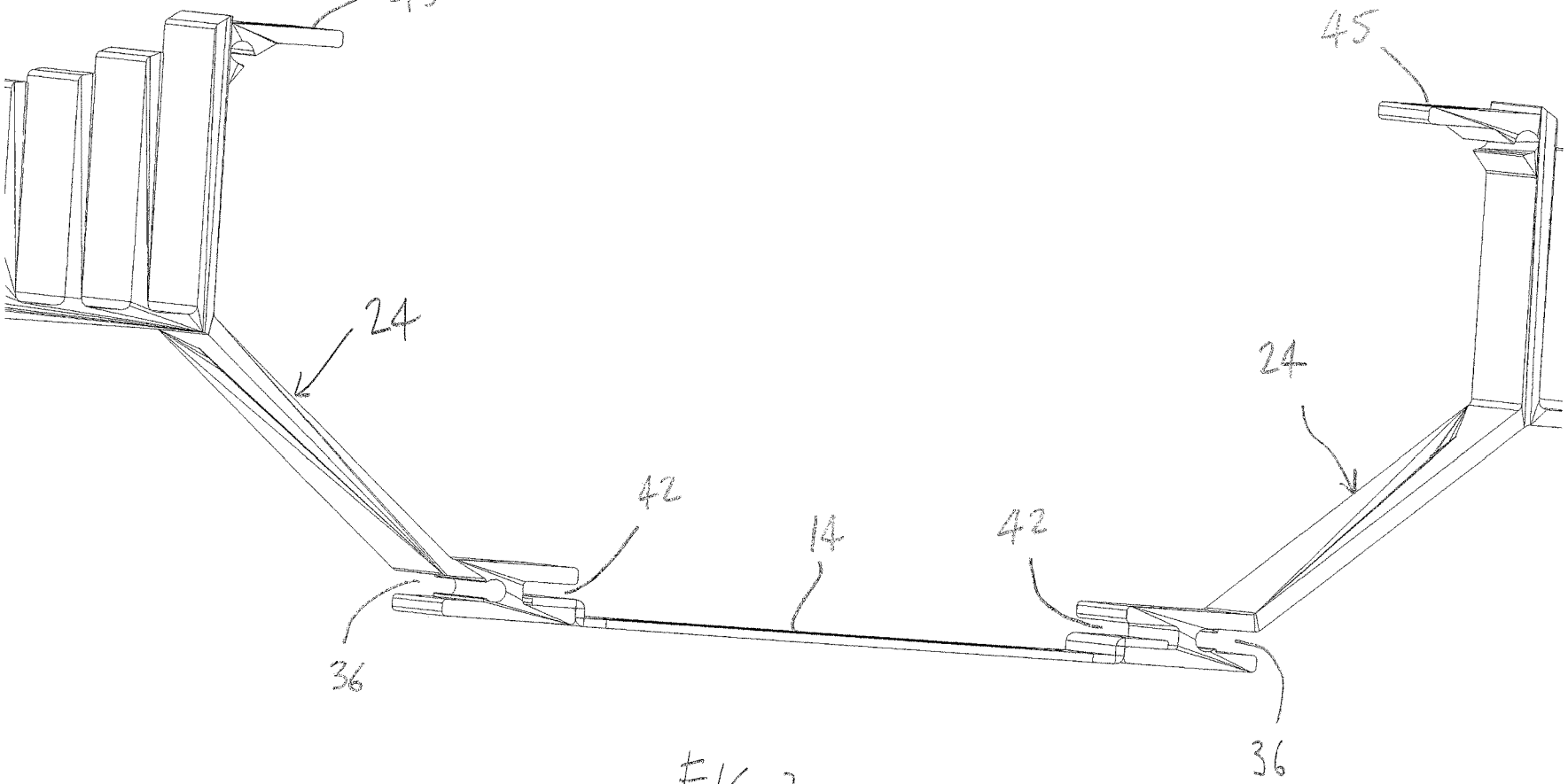
Figure 18:
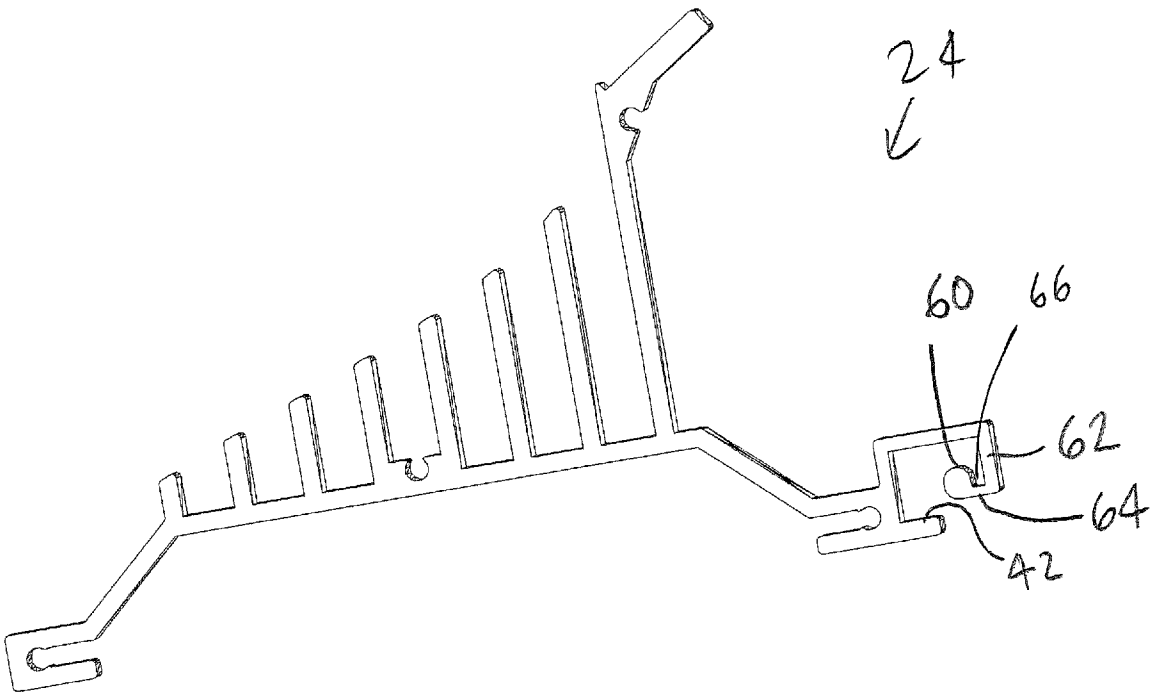
FIGS. 18-19 show a hinged mounting arrangement for the bottom plate in accordance with the subject invention.
Figure 19:
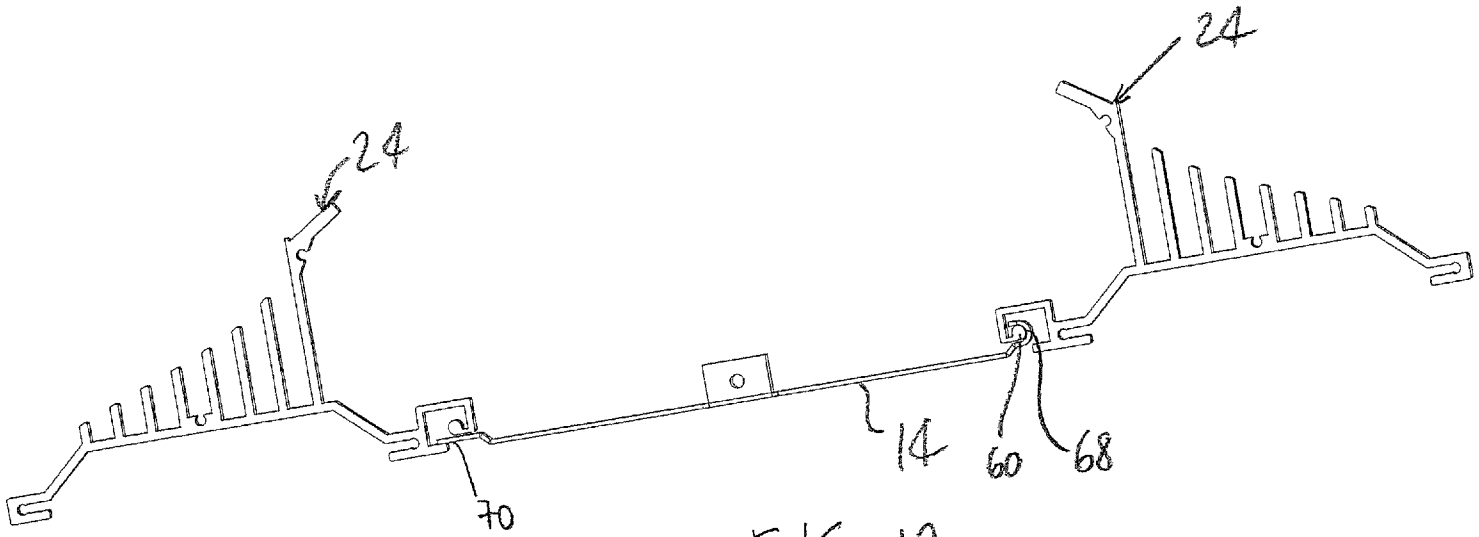

The bottom plate 14 and the upper plate 16 may be mounted to the lighting modules 12 in any manner. Secondary mounting channels 42 (FIG. 7) may be provided on the bodies 24 of the lighting modules 12 adjacent to the bottom plate 14 so as to edge support the bottom plate 14 therebetween. With reference to FIG. 18, the secondary mounting channels 42 may be each provided with a bead 60, e.g., on a downwardly extending wall 62 positioned to partially extend across the respective secondary mounting channel 42. A secondary wall 64 may extend inwardly from the wall 62 with the bead 60 being located on the secondary wall 64. A gap 66 may be provided between the bead 60 and the wall 62 to act as clearance. As shown in FIG. 19, the bottom plate 14 may be provided with a curved edge 68 formed to resiliently engage one of the beads 60 in providing a rotatable connection for the bottom plate 14 relative to the body 24 in the manner of a hinged connection. Opposing edge 70 of the bottom plate 14 may be received in the opposite secondary mounting channel 42 with the bead 60 thereof applying a resilient holding force. The opposing edge 70 may be raised or indented. With release of the opposing edge 70, the bottom plate 14 may be hingedly rotated using the curved edge 68 to gain access to the chamber 20. This configuration allows for the bottom plate 14 to be suspended in an open state without need for removal with return to a closed state when necessary. The upper plate 16 may be screw mounted, edge mounted, etc. to the bodies 24. Mounting features, such as ledges 45, may be provided on the bodies 24 for securing to the upper plate 16.

Figure 20:
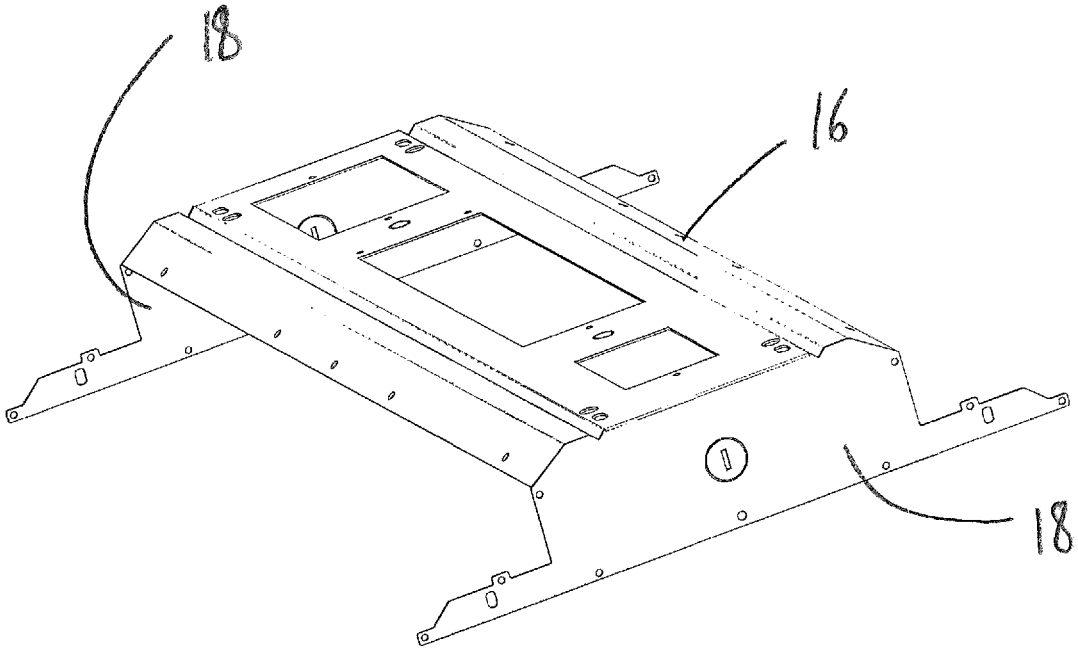
FIG. 20 shows a unitary construct of the upper plate and the endcaps in accordance with the subject invention.
Figure 21:
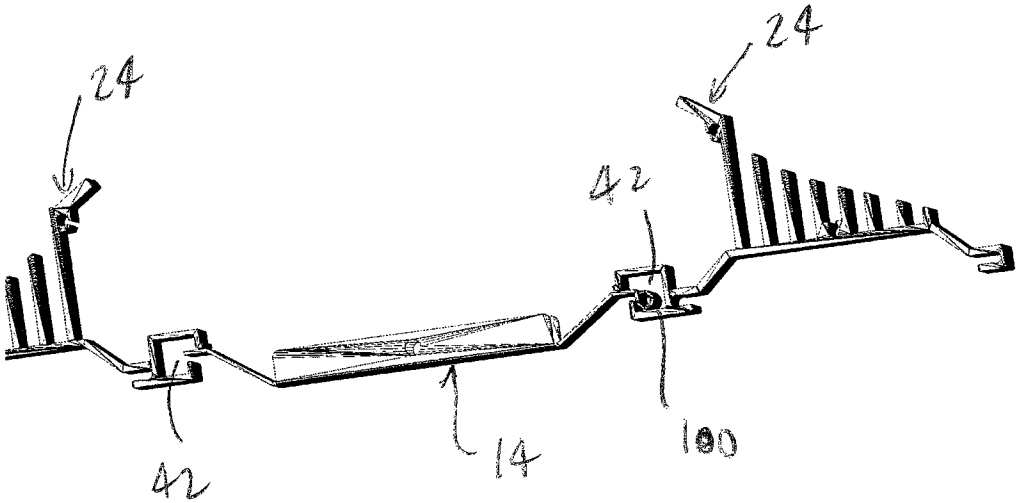
FIGS. 21-26 show a sliding hinged mounting arrangement for the bottom plate in accordance with the subject invention; and, FIGS. 27-28 show a mounting arrangement for allowing removal of the lens or diffuser.
Figure 22:
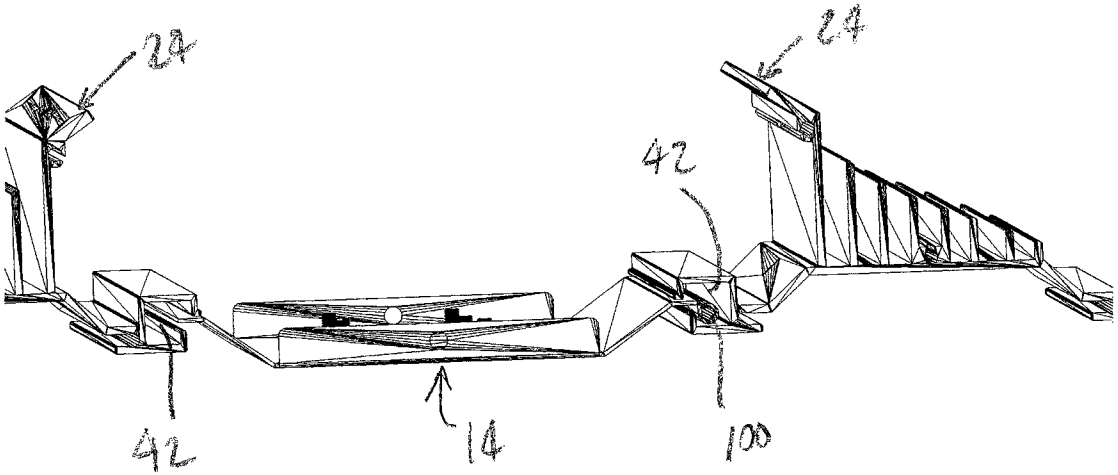
Figure 23:
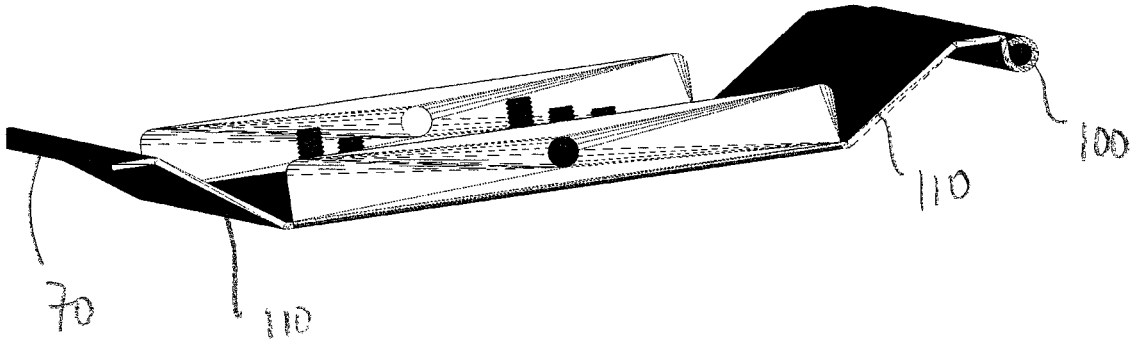
Figure 24:
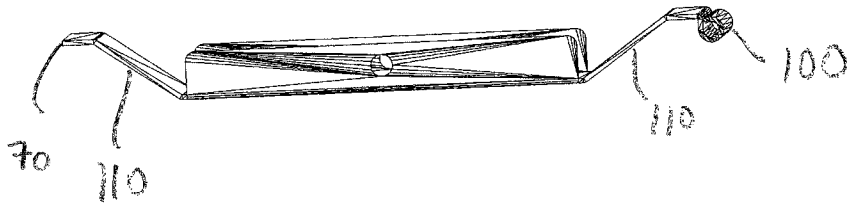
Figure 25:
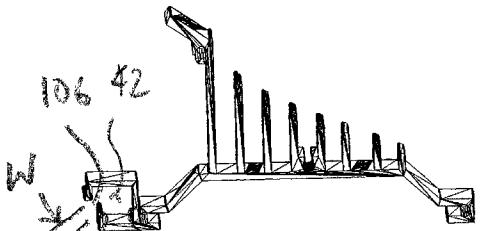
Figure 26:
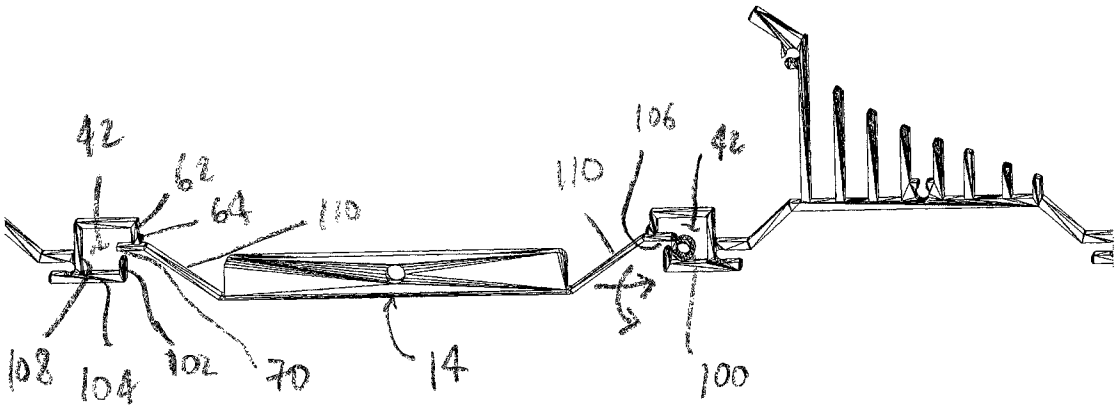

To provide the lighting fixture 10 with a closed appearance, the endcaps 18 are provided to extend across opposing ends of the lighting fixture 10. The endcaps 18 may be secured in any known manner, including being screw mounted, e.g., to the lighting modules 12. Preferably, the endcaps 18 at least partially overlie the open channels 26 and the chamber(s) 20. Also, preferably, the endcaps 18 at least partially overlie the bottom plate 14 and the upper plate 16. The open channels 26 are preferably fully enclosed by the endcaps 18 and the respective lens or diffusers 34. As shown in FIG. 20, the upper plate 16 may be formed unitary with one or both of the endcaps 18.

A guard 44, which may be a wire guard, may be utilized to provide at least some level of protection for the lighting fixture 10, particularly with respect to the light generating side of the lighting fixture 10.

As will be appreciated by those skilled in the art, the lighting fixture 10 may be scaled to larger sizes with the addition of lighting modules 12, e.g., more than two of the lighting modules 12. The addition of lighting modules results in the use of additional bottom plates and upper plates. Interiorly located lighting modules may be adapted to have mounting channels along both edges of the respective open channel to permit edge mounting on both sides of bottom plates. The addition of lighting modules also results in additional chambers. Electrical components may be provided in the chamber(s) as needed for the lighting fixture. It may be that single components, such as a single sensor or driver, are provided, even with two or more chambers. The chambers do not need to be equipped equally.

In addition, the lighting fixture 10 may be scaled to various sizes with the use of generally constant cross-section bodies 24 for the lighting modules 12 which allows for long extrusions being formed and cut to length as required. Likewise, the bottom plate 14 and the upper plate 16 may be cut to length as required. The lighting fixture 10 may be scaled in both length and width based on the number of lighting modules 12 and the length thereof.

The lighting fixture 10 may be mounted in any known manner including by suspension cables 46 and/or posts 48 which are secured to the lighting fixture 10 through mounting holes, brackets and other known manners.

With reference to FIGS. 21-26, the bottom plate 14 may be mounted to the lighting modules 12 so as to be movable relative thereto. The bottom plate 14 is formed with an enlarged edge 100. The enlarged edge 100 may define an acruate profile. The secondary mounting channels 42 are formed similar to the configuration shown in FIG. 7, but that the secondary wall 64 extends outwardly from the wall 62. The secondary wall 64 may be curved to have a downwardly directed apex. The bead 60 is not required in this configuration.

With the configuration of FIGS. 21-26, a tertiary wall 102 may be also provided for each of the secondary mounting channels 42 which extends upwardly from base 104. A gap 106 is defined between the wall 62 and the tertiary wall 102 through which the bottom plate 14 extends to be received within the secondary mounting channels 42. Preferably, the gap 106 defines a width W which is smaller than the diameter of the enlarged edge 100 such the enlarged edge 100 may not pass through the gap 106. In this manner, the enlarged edge 100 is maintained within one of the secondary mounting channels 42. The bottom plate 14 may be mounted to the lighting modules 12 by being slid in through the ends thereof.

The bottom panel 14 is formed with sufficient length between enlarged edge 100 and opposing edge 70 to span the space between the secondary mounting channels 42. This allows for the bottom panel 14 to be edge supported simultaneously by the secondary mounting channels 42. It is preferred that the distance D between the tertiary wall 102 and back wall 108 be great enough so that, with sufficient movement of the enlarged edge 100 toward the back wall 108, the opposed edge 70 clears the secondary mounting channel 42. This allows for the bottom panel 14 to be rotated about the enlarged edge 100. Rotation of the bottom panel 14 allows access to the chamber 20 with the lighting fixture 10 being installed.

Portions 110 of the bottom panel 14 may be bent or otherwise configured to provide additional clearance for rotation of the bottom panel 14.

Figure 27:
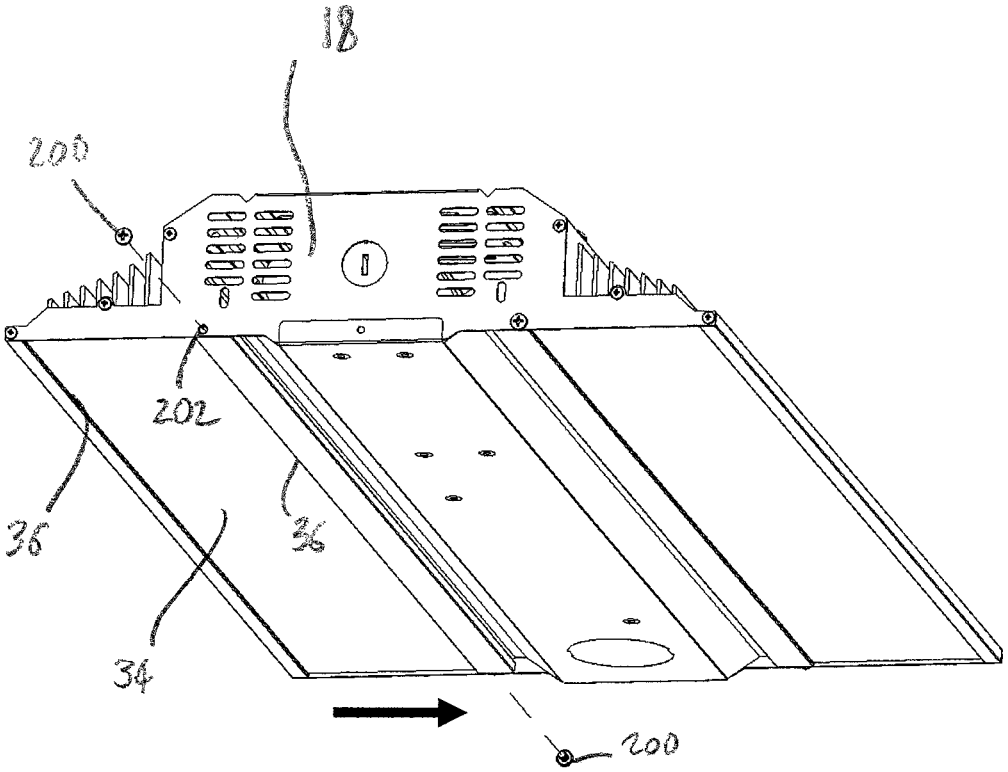
Figure 28:
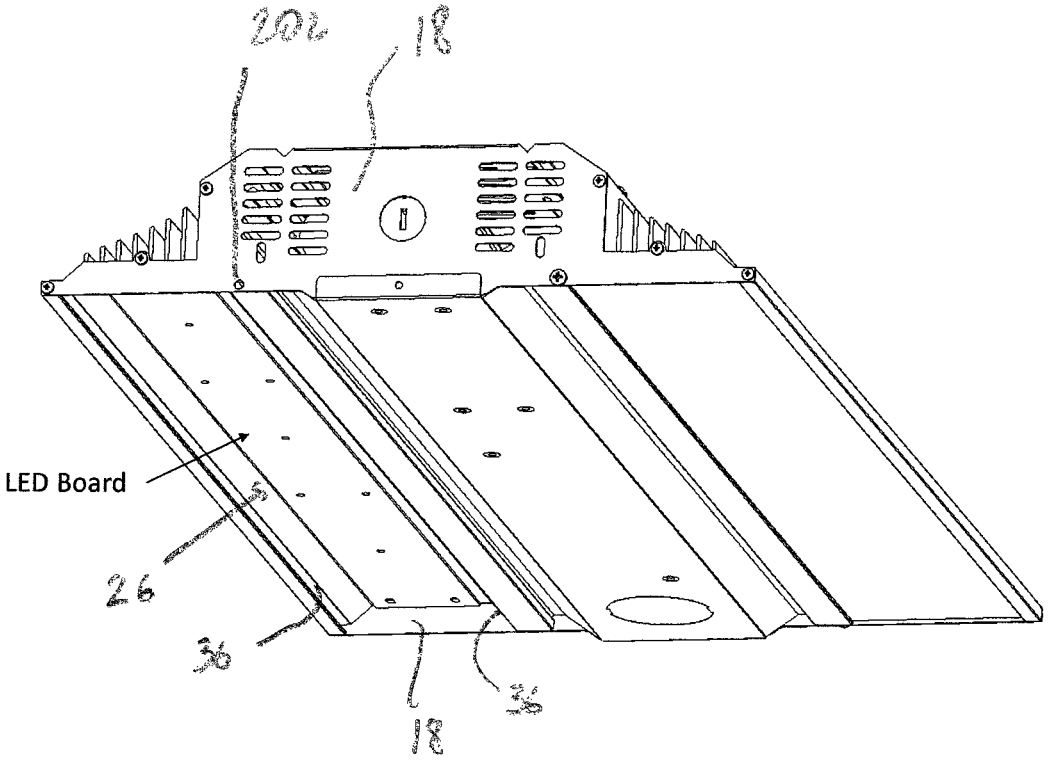

With reference to FIGS. 27-28, an arrangement is shown which permits removal of the lens or diffuser 34 from its lighting module 12 with the lighting fixture 10 being installed. In particular, at least one of the mounting channels 36 is formed deeper to allow axial shifting of the lens or diffuser 34 while received in the mounting channels 36. The mounting channel 36 is made sufficiently deep so that the lens or diffuser 34 may be sufficiently shifted to remove it from the opposite mounting channel 36, thereby freeing an edge of the lens or diffuser 34. With a freed edge, the lens or diffuser 34 may be re-directed and removed from the open channel 26. In this manner, the open channel 26 may be accessed with the lighting fixture 10 being installed.

To prevent unwanted movement of the lens or diffuser 34 relative to the mounting channels 36, one or more removeable stops 200 may be provided. The removeable stops 200 may be configured to extend into one or both of the mounting channels 36 located to inhibit axial shifting of the lens or diffuser 34. With removal of the removeable stops 200, the lens or diffuser 34 may then be axially shifted to allow for removal of the lens or diffuser 34.

The removeable stops 200 may be mounted to apertures 202 located in the endcaps 18, in any known manner. For example, the removeable stops 200 may be threadedly mounted, frictionally mounted, interference mounted, and/or cooperative mounting (where elements coact to retain the removable stops 200). It is preferred that the removeable stops 200 (and the apertures 202) be located in proximity to the bottom edge of the endcaps 18 to facilitate removal and re-mounting of the re-moveable stops 200.

What is claimed is:

1. A modular solid state high-bay lighting fixture comprising:

first and second bodies, each said body defining an open channel along one face;

a plurality of solid state light generating elements disposed within said open channels of said first and second bodies;

a first lens extending across said open channel of said first body;

a second lens extending across said open channel of said second body, said second lens being spaced from said first lens;

a bottom plate extending between, and in contiguous contact with, said first and second bodies; and, an upper plate extending between, and in contiguous contact with, said first and second bodies, wherein said upper plate being spaced from, and at least partial overlying, said bottom plate so as to partially define a chamber between said first and second bodies, wherein, said first and second bodies include first and second secondary mounting channels, respectively, wherein, in a first state, said bottom plate having spaced apart first and second edges received in the first and second secondary mounting channels, respectively, wherein, the bottom plate being selectively movable relative to the first and second secondary mounting channels to a second state by shifting said second edge deeper into said second secondary mounting channel away from said first secondary mounting channel thereby causing said first edge to be removed from said first secondary mounting channel, wherein, said second secondary mounting channel includes a base, an upstanding front wall along a first edge of said base, an upstanding rear wall along a second edge of said base, spaced from said first edge, and, an upper wall extending transversely from said rear wall, spaced from said base, a gap being defined between said front wall and said upper wall through which said bottom plate extends to have said second edge received in said second secondary mounting channel, said second edge being enlarged so as to not be passable through said gap, said bottom plate being rotatable about said second edge with said bottom plate in the second state.

2. A lighting fixture as in claim 1, wherein said second edge defining an arcuate profile larger than said gap.

3. A lighting fixture as in claim 1, wherein said first body is provided with first and second mounting channels along edges of said open channel, said first lens being mounted to said first body with insertion into said first and second mounting channels.

4. A lighting fixture as in claim 3, wherein said first mounting channel is formed sufficiently deep to permit sufficient shifting of said first lens thereinto so as to be removed from said second mounting channel.

5. A lighting fixture as in claim 4, wherein at least one stop is provided for said first mounting channel to restrict excessive shifting of said first lens into said first mounting channel.

6. A lighting fixture as in claim 1, wherein a spacing is defined between said front wall and said rear wall to provide said second edge with sufficient clearance to allow shifting between said first and second states.

7. A lighting fixture as in claim 1, wherein said upper wall has a L-shaped cross-section.

* * * * *